US008287249B2

(12) United States Patent
Fuksa et al.

(10) Patent No.: US 8,287,249 B2
(45) Date of Patent: Oct. 16, 2012

(54) TWO-STAGE MEMBRANE PUMP WITH ECONOMICAL INLET PORT DESIGN

(75) Inventors: Richard C. Fuksa, Park Ridge, IL (US); Reno G. Knudsen, Manitowoc, WI (US)

(73) Assignee: Gardner Denver Thomas, Inc., Sheboygan, WI (US)

( * ) Notice: Subject to any disclaimer, the term of this patent is extended or adjusted under 35 U.S.C. 154(b) by 821 days.

(21) Appl. No.: 12/340,465

(22) Filed: Dec. 19, 2008

(65) Prior Publication Data

US 2010/0158708 A1 Jun. 24, 2010

(51) Int. Cl.
*F04B 3/00* (2006.01)

(52) U.S. Cl. ..... 417/245; 417/244; 417/413.1; 417/475; 417/415

(58) Field of Classification Search ..... 417/244–268, 417/413.1, 475, 415
See application file for complete search history.

(56) References Cited

U.S. PATENT DOCUMENTS

| | | | | |
|---|---|---|---|---|
| 3,173,606 | A * | 3/1965 | Dobrowolski | 418/60 |
| 4,049,366 | A | 9/1977 | Becker | |
| 4,086,036 | A | 4/1978 | Hagen et al. | |
| 5,145,336 | A | 9/1992 | Becker et al. | |
| 7,040,869 | B2 | 5/2002 | Beenker | |
| 6,776,591 | B1 | 8/2004 | Rinninger et al. | |
| 7,850,431 | B2 * | 12/2010 | Gonnella et al. | 417/44.2 |
| 2009/0060756 | A1 * | 3/2009 | Jones | 417/254 |

* cited by examiner

*Primary Examiner* — Joseph L Williams
*Assistant Examiner* — Fatima Farokhrooz
(74) *Attorney, Agent, or Firm* — James B. Conte; Husch Blackwell LLP

(57) ABSTRACT

A two-stage membrane pump having a first pump head and a second pump head is provided. The pump heads are typically crank operated with a camshaft set up such that one pump head is in exhaust mode and the other in inlet mode, and vice-versa, during operation. The membrane and the inlet and outlet valves of the pump heads are designed to work together, along with each pump head working synchronously such that the inlet of the second pump head and exhaust of the first pump head are sealed by the actions of the two membranes. As a result an inlet valve in the second pump head is not needed. The costs of such a pump are thereby reduced while increasing the reliability of the two-stage pump.

12 Claims, 4 Drawing Sheets

TWO-STAGE MEMBRANE PUMP WITH ECONOMICAL INLET PORT DESIGN

FIELD OF THE INVENTION

The present invention concerns a two-stage membrane pump having an economical inlet port design. More particularly the present invention concerns a two-stage membrane pump wherein due to the design of the membrane and the placement of the inlet and outlet ports in the first and second stages, the second stage inlet can be created without an inlet valve.

BACKGROUND OF THE INVENTION

Membrane pumps are a well known type of pump in which a reciprocating piston is replaced by a membrane so that no liquid or gas, as determined by the use to which the pump is made, leaks out of the pumping chamber during use. Such could occur in a pump having a worn piston. The assignee of the present invention is the owner of U.S. Pat. No. 6,776,591 (hereinafter the "'591 patent"), entitled Membrane Pump Comprising An Inlet Opening That is Controlled By The Membrane; this patent is incorporated herein in its entirety as if set forth in full herein. The '591 patent describes a pump using a membrane along with the advantageous placement of the inlet and outlet ports of the pump such that maximum compression and pump efficiency can occur. The design of the pump taught in the '591 patent provides for an efficient and low cost pump capable of high compression as a result of the advantageous placement of the inlet and outlet ports such that the membrane closes the inlet port of the pump at a position allowing the greatest potential compression and therefore pumping efficiency.

Often times, however, a two stage pump is required to perform the necessary pumping operation, providing extra pumping power not otherwise possible with the single stage pump. For example one pump is designed to draw a fluid or gas from one location and the second pump is designed to accept that liquid or gas and pump it to a destination. Typically the two-stage pump is constructed of two single stage pumps joined together in series, and held in a single housing, such that the outlet of the first stage feeds the inlet of the second stage. Often times a camshaft system is aligned such that the pumps operate synchronically such that when the first stage is at a top dead center the second stage is at a bottom dead center position. In prior two-stage pumps, each of the pumps that make the two stages are typically identical pumps having identical equipment. The two stages are therefore really two pumps working in unison. A two stage pumping system is therefore usually twice as expensive to manufacture as a single stage pump and requires substantially more maintenance to maintain each pump as well as the synchronicity of the pumps working together.

It would therefore be an advantage to have a two stage pump that requires fewer parts and therefore less cost to manufacture, as well as requiring concomitantly less maintenance.

SUMMARY OF THE INVENTION

In accordance with the present invention, a two-stage pump is provided. The pump is constructed with a first and second pump head designed to work in synchronicity with each other to permit one pump to draw fluid or gas from a source and the other to propel the fluid or gas out of the pump to a destination. The pump chamber of the first pump head includes an inlet port and an exhaust port; each port having a valve within the port to seal the pump head at appropriate times within the pump operation. The second pump head is constructed with a pump chamber and an inlet port and exhaust port, much like the first pump head. However, the inlet port of the second pump head, which is in the direct connection of flow with the exhaust port of the first pump head has no valve, the outlet port of the second pump head includes an outlet valve.

In some embodiments, the pump heads each include a crank, along with a camshaft system, to drive the flexible diaphragm. The flexible diaphragm having a surface area suitable for sealing and unsealing the pumping chamber of each of the first pump head and second pump head respectively in pumping relationship. The action of the first and second diaphragms, acting in pumping relation, provide alternatively the opening and closing of the first pump head exhaust and second pump head inlet such as to obviate the need of an inlet valve for the second pump head.

In embodiments of the present invention the pump chambers each comprise an inner surface and the diaphragms comprises a top surface shaped so as to seal the inner surface of each pump head at top dead center of the crank motion. Further, in such an embodiment, when the crank of the first pump head is at top dead center the crank of the second pump head is at bottom dead center. In some embodiments, the pump chambers each have a generally circular cross section and comprise a concave inner surface and the top surfaces of the diaphragms define a circular plane.

In the preferred embodiment, to allow the pump to create the greatest compression possible, the inlet port of each pump head is located adjacent the circumference of the diaphragm such that the compression stroke of the pump causes the early close, relative to the pump action, of the inlet port. In such an embodiment, a first and second clamping ring are provided for each pump head such that the diaphragm in each is clamped at their respective circumferences within pump heads. To allow for the best pump action, the diaphragm comprises a flexible membrane.

A more detailed explanation of the invention is provided in the following description and claims and is illustrated in the accompanying drawings.

DETAILED DESCRIPTION OF THE ILLUSTRATIVE EMBODIMENT

Figure 1:
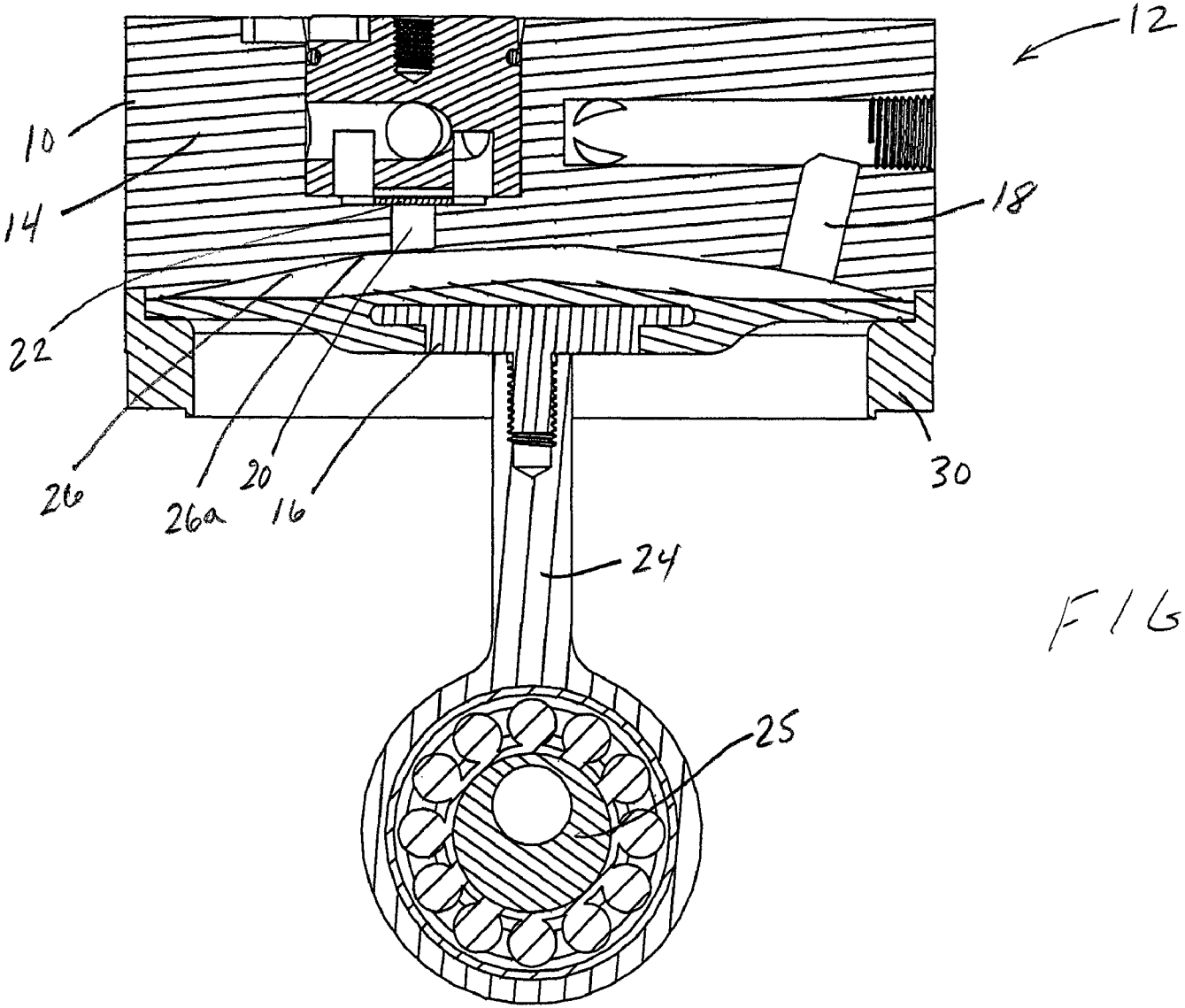
FIG. 1 is a cross-sectional view of a second pump head of a two-stage pump made in accordance with the teachings of the present invention in an intake position.

While the present invention is susceptible of embodiment in various forms, there is shown in the drawings a number of presently preferred embodiments that are discussed in greater detail hereafter. It should be understood that the present disclosure is to be considered as an exemplification of the present invention, and is not intended to limit the invention to the specific embodiments illustrated. It should be further understood that the title of this section of this application ("Detailed Description of the Illustrative Embodiment") relates to a requirement of the United States Patent Office, and should not be found to limit the subject matter disclosed herein.

Referring now to the drawings, FIG. 1 a second stage membrane pump 10 of a two-stage membrane pump 12 is shown in cross-sectional view. The pump 10 is generally the second stage pump body of the two-stage pump 10 and is shown in an intake configuration. The pump 10 comprises a pump head 14 a diaphragm 16 and an intake port 18 as well as a pump chamber 26. It will be understood by persons having ordinary skill in the art that pump chamber 26 and diaphragm 16 are designed to seat together to form a seal. Diaphragm 16 is created of a flexible material, such as a membrane so that it can flexibly seal chamber 26 and retain its elasticity to assist in pumping fluid or gas. Various materials can be utilized to create membrane 16 as will be known by persons having ordinary skill in the art.

It will be seen that intake port 18 does not include a valve at its opening. The pump further comprises an exhaust port 20 having an exhaust valve 22 and a connection rod 24. Connection rod 24 provides the motive force for pump 12 through camshaft 25, which is connected to a motor and to the first stage membrane pump (110 in FIG. 4). As noted above, a pump chamber 26 is shown having a concave shaped surface 26. A clamping ring 30, for holding diaphragm 16 to pump head 14 is included. An inlet port connection 28, connecting inlet port 18 to the exhaust port 118 of the first stage membrane pump 110 which will be described in greater detail below.

Figure 2:
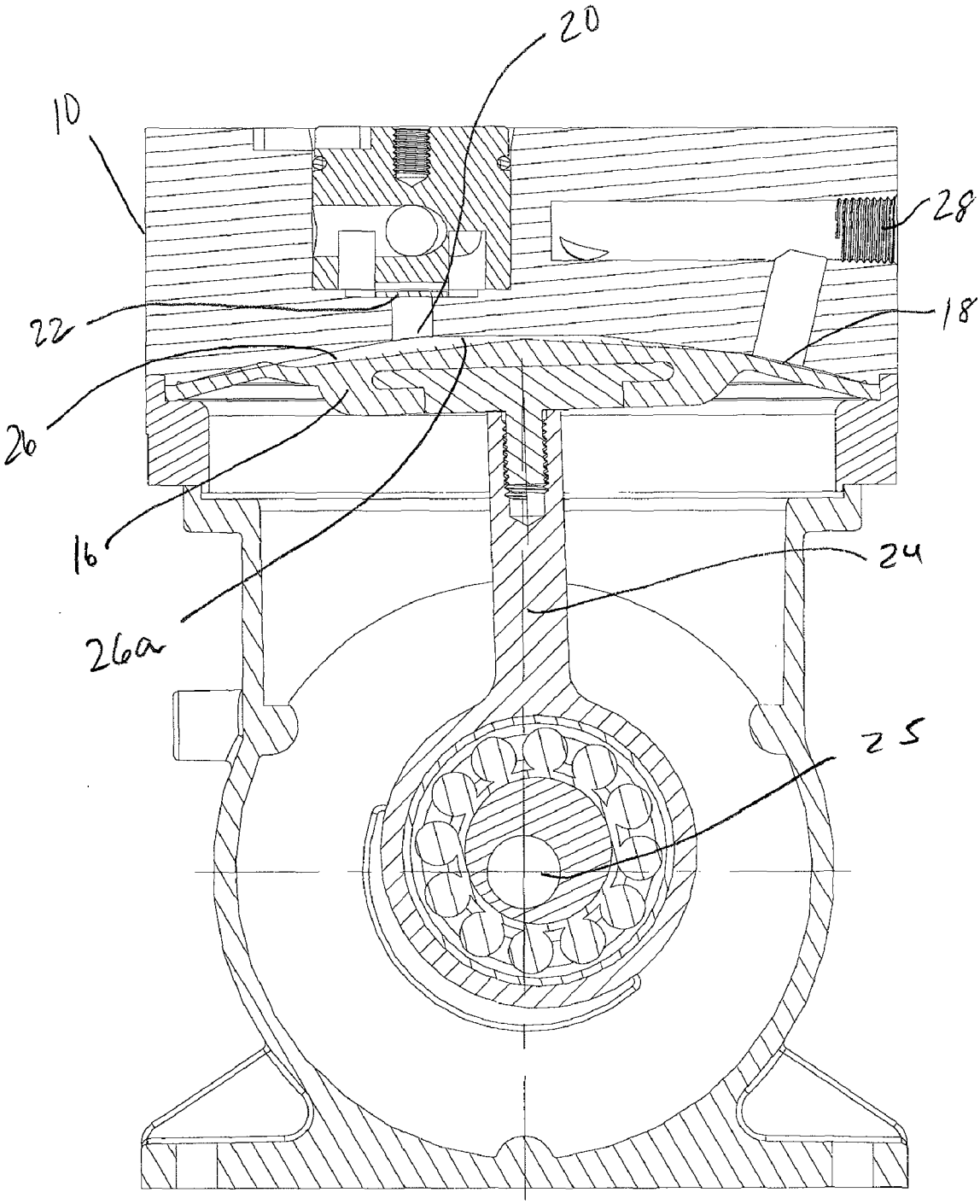
FIG. 2 is a cross-sectional view of a second pump head of a two-stage pump made in accordance with the teachings of the present invention in an exhaust position.

Referring now to FIG. 2, pump 10 is shown in an intermediate exhaust configuration. It will be seen that diaphragm 16 has moved up towards pump chamber surface 26*a* causing diaphragm 16 to seal intake port 18. Exhaust port 20 remains uncovered as diaphragm 16 pushes upward to empty the pump chamber through the exhaust port. As the cycle continues, exhaust port 20 will be sealed by diaphragm 16 so as to prevent the re-inhalation of materials previously pumped out.

Figure 3:
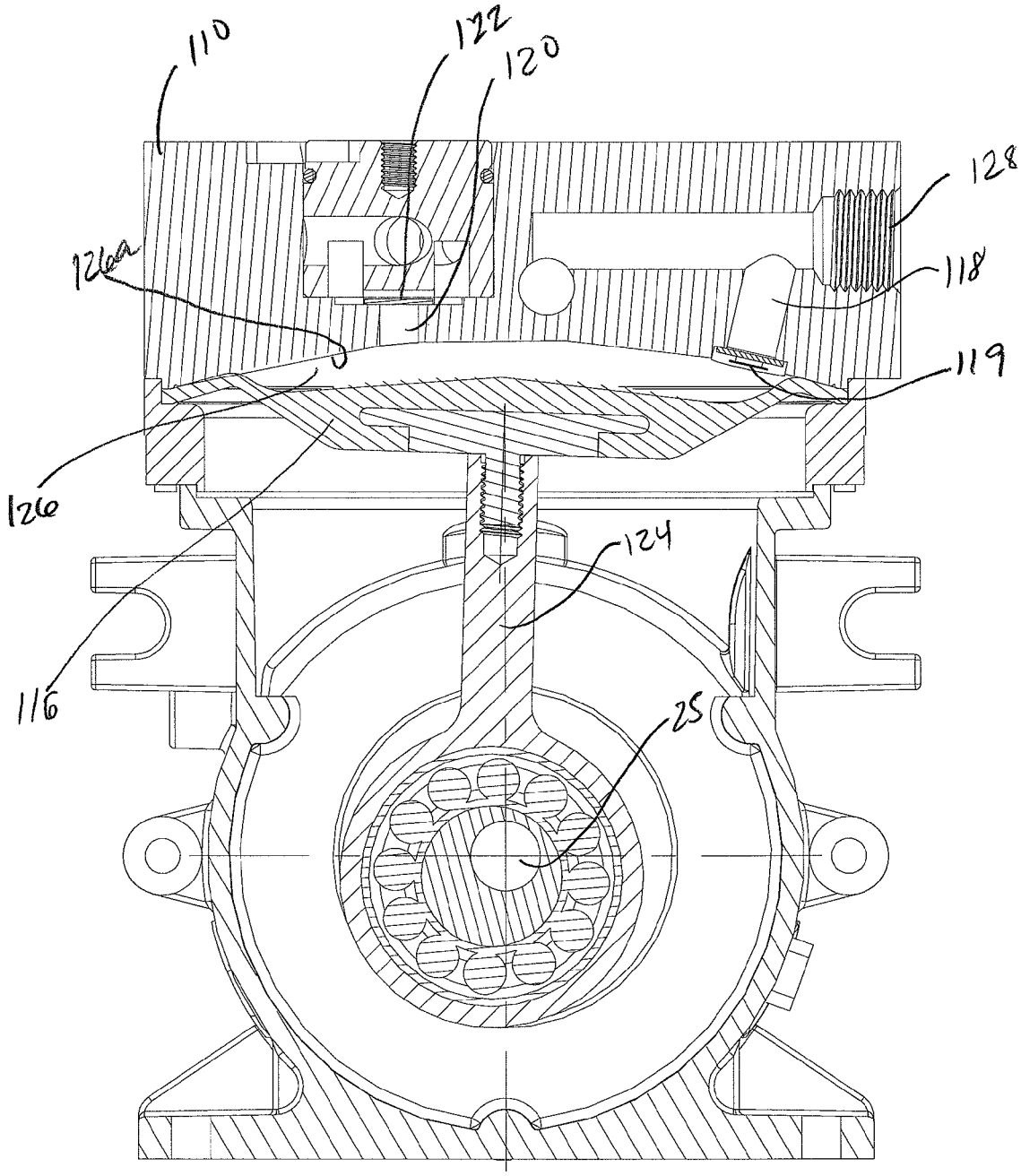
FIG. 3 is a cross-sectional view of a first pump head of a two-stage pump made in accordance with the teachings of the present invention in an intake position.

First stage pump 110 is shown in FIG. 3. Pump 110 comprises similar elements to those shown with respect to second stage pump 10, numbered similarly for ease of understanding. Pump 110 includes a pump head 114, a diaphragm 116 and an intake port 118. It will be seen that intake port 118 does include a valve 119 at its opening in sharp contrast to the intake port of the second stage pump 10. The pump 110 further comprises an exhaust port 120 having an exhaust valve 122 and a connection rod 124. Connection rod 124 provides the motive force for pump 12 through camshaft 25, which is connected to a motor and to the second stage membrane pump as previously described. A pump chamber 126 is shown having a concave shaped surface 126. A clamping ring 130, for holding diaphragm 116 to pump head 114 is included. An inlet port connection 128, connecting inlet port 18 to the source of the material to be pumped is shown.

Figure 4:
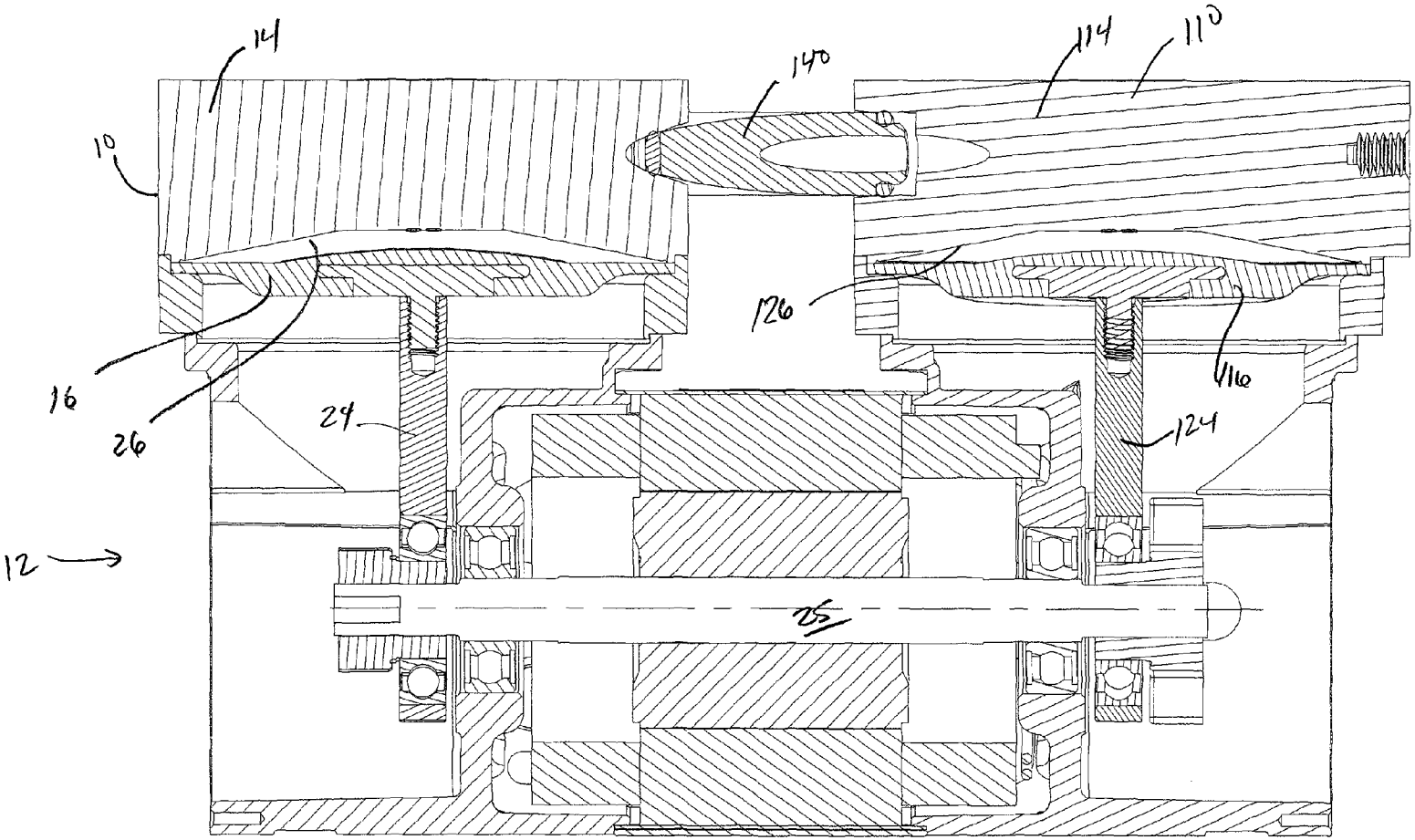
FIG. 4 is cross-sectional view of a two-stage pump made in accordance with the present invention.

The relative connection of pumps 10 and 110, within two-stage membrane pump 12 is shown in FIG. 4, wherein the connection 140 between first and second stage pumps (110 and 10 respectfully) is shown. As will be understood the materials pumped by pump stage 110 enter inlet 128 and proceed through to pump 110 via inlet port 118 past inlet valve 119 upon connecting rod 124 being drawn down in its cycle. Diaphragm 116 is drawn down by rod 124 causing inlet valve 119 to be pulled down in an open position. Fluid or gas are drawn into pump chamber 126 until camshaft 25 makes a revolution bringing rod 124 back up thereby pushing diaphragm 116 back against the top surface 126*a* of pump chamber 126. In its progression, diaphragm 116 is pushed first against inlet valve 119 causing it to seal inlet 118; this is a direct result of the proximity of inlet 118 to the circumference of diaphragm 116. As the rod continues to push upwards the fluid or gas within the chamber is compressed and pushed into exhaust port 120, pushing valve 122 upwards and exhausting the gas towards inlet port 28 of second stage pump 10.

Second stage pump 10, in rotational connection with camshaft 25, starts its intake phase as the exhaust phase of pump 110's progresses. The exhausted material is drawn into second stage 10 through inlet 18. No inlet valve is needed due to the actin of diaphragm 16, which, as a result of the placement of inlet 18, seals the inlet such that no valve is required. Material is pumped into pump chamber 26 and then, by action of rod 24 on diaphragm 16, as previously described, the materials are exhausted through port 20. It will be understood that the removal of a valve from the intake of a diaphragm pump can be accomplished in the present invention as a result of the action of the diaphragm along with the placement of the inlet opening near the circumferential edge of the pump head surface; thereby allowing the diaphragm to act as a valve in its exhaust stage.

Although an illustrative embodiment of the invention has been shown and described, it is to be understood that various modifications and substitutions may be made by those skilled in the art without departing from the novel spirit and scope of the invention.

What is claimed is:

1. A two-stage pump, comprising:

a first pump head having a pump chamber and an inlet port and an outlet port, the inlet port having an inlet valve and the outlet port having an outlet valve;

a second pump head having a pump chamber and an inlet port and an exhaust port, the inlet port of the second pump head being in direct connection of flow with the outlet port of the first pump head wherein the inlet port of second pump head does not include an inlet valve to regulate fluid flow in or out of the inlet port of second pump head, the exhaust port having an exhaust valve;

a first and second flexible diaphragm each having a surface area suitable for sealing and unsealing the pumping chamber of each of the first pump head and second pump head respectively in pumping relationship;

wherein, the action of the first and second diaphragms acting in pumping relation provide alternatively the opening and closing of the first pump head outlet port and second pump head inlet port;

and wherein during an upstroke of the second flexible diaphragm, the second flexible diaphragm is configured to substantially seal the inlet port of the second pump head.

2. The two-stage pump of claim 1, including a crank for each pump and wherein the pump chambers each comprise an inner surface and the diaphragms comprises a top surface shaped so as to seal the inner surface of each pump head at top dead center of the crank motion.

3. The two-stage pump of claim 1 wherein the diaphragm comprises a flexible membrane.

4. The two-stage pump of claim 2, wherein when the crank of the first pump head is at top dead center the crank of the second pump head is at bottom dead center.

5. The two-stage pump of claim 2, wherein the pump chambers each have a generally circular cross section and comprise a concave inner surface and the top surfaces of the diaphragms define a circular plane.

6. The two-stage pump of claim 5, wherein the inlet port of each pump head is located adjacent the circumference of the diaphragm such that the compression stroke of the pump causes the early close, relative to the pump action, of the inlet port.

7. The two-stage pump of claim 5, including a first and second clamping ring and wherein each of the diaphragms is clamped at their respective circumferences to respectively the first pump head and the second pump head.

8. A two-stage pump, comprising:

a first pump head having a pump chamber and an inlet port and an outlet port, the inlet port having an inlet valve and the outlet port having an outlet valve;

a second pump head having a pump chamber and an inlet port and exhaust port, the inlet port of the second pump head being in direct connection of flow with the outlet port of the first pump head wherein the inlet port of second pump head does not include an inlet valve to regulate fluid flow in or out of the inlet port of second pump head, the exhaust port having an exhaust valve;

the first and second pump heads having each having a concave top surface;

a first and second flexible membrane each having a surface area suitable for sealing and unsealing the pumping chamber of each of the first pump head and second pump head respectively in pumping relationship and having a top surface defining a circular plane;

wherein, the action of the first and second membranes acting in pumping relation provide alternatively the opening and closing of the first pump head outlet port and second pump head inlet port.

9. The two-stage pump of claim 8, including a crank for each pump and wherein the pump chambers each comprise an inner surface and the membrane comprises a top surface shaped so as to seal the inner surface of each pump head at top dead center of the crank motion.

10. The two-stage pump of claim 9, wherein when the crank of the first pump head is at top dead center the crank of the second pump head is at bottom dead center.

11. The two-stage pump of claim 8, wherein the inlet port of each pump head is located adjacent the circumference of the membrane such that the compression stroke of the pump causes the early close, relative to the pump action, of the inlet port.

12. The two-stage pump of claim 11, including a first and second clamping ring and wherein each of the membranes is clamped at their respective circumferences to respectively the first pump head and the second pump head.

* * * * *